United States Patent [19]

Goloff

[11] 4,067,671

[45] Jan. 10, 1978

[54] MEANS FOR LOCKING HOUSING PARTS AGAINST RELATIVE MOVEMENT

[75] Inventor: Alexander Goloff, East Peoria, Ill.

[73] Assignee: Caterpillar Tractor Co., Peoria, Ill.

[21] Appl. No.: 691,948

[22] Filed: June 1, 1976

[51] Int. Cl.[2] ..... F01C 19/00; F16J 15/02

[52] U.S. Cl. ..... 418/149; 29/156.4 R; 29/459; 277/189; 277/235 B

[58] Field of Search ..... 418/149; 123/193 R; 92/169; 29/156.4 R, 432, 459; 277/114, 189, 190, 191, 235 B

[56] References Cited

U.S. PATENT DOCUMENTS

| | | | |
|---|---|---|---|
| 2,707,441 | 5/1955 | Drennen | 418/149 X |
| 3,289,647 | 12/1966 | Turner et al. | 418/61 A X |
| 3,440,703 | 4/1969 | Millhiser | 29/432 X |
| 3,606,361 | 9/1971 | Pohl et al. | 277/235 B |
| 3,828,515 | 8/1974 | Galgoczy et al. | 29/432 X |

FOREIGN PATENT DOCUMENTS

| | | | |
|---|---|---|---|
| 1,360,604 | 3/1964 | France | 418/149 |

*Primary Examiner*—Carlton R. Croyle
*Assistant Examiner*—Leonard E. Smith
*Attorney, Agent, or Firm*—Wegner, Stellman, McCord, Wiles & Wood

[57] ABSTRACT

An apparatus having mating housing parts including a thin metallic sheet disposed at the interface of the housing parts and having multiple, short prongs extending from a side thereof to embed within one of the housing parts to thereby prevent relative movement between the housing parts, and a seal carried by the sheet.

3 Claims, 4 Drawing Figures

MEANS FOR LOCKING HOUSING PARTS AGAINST RELATIVE MOVEMENT

BACKGROUND OF THE INVENTION

This invention relates to means for securing mating housing parts against relative movement and for sealing the interface of such parts. While not limited to, the invention is particularly suited for use with rotary mechanisms.

The most pertinent prior art known to the applicant includes the following U.S. Pat. Nos.: 3,196,853 to Jungbluth of July 27, 1965; 3,224,422 to Autrum of Dec. 21, 1965; 3,791,781 to Fujiyama of Feb. 12, 1974; and 3,809,509 to Lamm of May 7, 1974.

There are many applications where one or more housing parts are clamped together to avoid fretting or rubbing between the housing parts. It is frequently desired that the interface of such housing parts be sealed as well.

In trochoidal mechanisms, for example, the problem may be particularly acute where the center housing is clamped to end housings in that, during operation of such mechanisms, under pressure, the center housing tends to expand toward a circular shape.

Heretofore, clamping means in the form of tight fitting bolts have been employed. Such means are quite expensive to fabricate and are difficult to service in that the bolt receiving holes in the housing have a tendency to become smaller due to plastic flow of the housing metal, thus pinching the bolts.

SUMMARY OF THE INVENTION

It is the principal object of the invention to provide new and improved means for precluding relative movement between mating housing parts. More specifically, it is an object of the invention to provide such means which are operative to seal the housing parts and which are of inexpensive construction.

An exemplary embodiment of the invention achieves the foregoing object in a structure including a thin metallic sheet disposed at the interface of mating housing parts and having multiple, short prongs extending from a side thereof to embed within one of the housing parts. Sealing means are carried by the sheet.

In a preferred embodiment, the prongs extend from both sides of the sheet.

In one embodiment, the sealing means comprise a layer of gasket material on the sheet with the prongs extending through the layer.

In another embodiment, the sealing means comprise an O-ring.

In a highly preferred embodiment, the prongs are hardened and plural sheets are disposed between the center housing and flanking end housings of a rotary mechanism having a shaft and a rotor to seal the interfaces and to preclude relative movement between the center and end housings.

Other objects and advantages will become apparent from the following specification taken in connection with the accompanying drawings.

DESCRIPTION OF THE PREFERRED EMBODIMENTS

Figure 1:
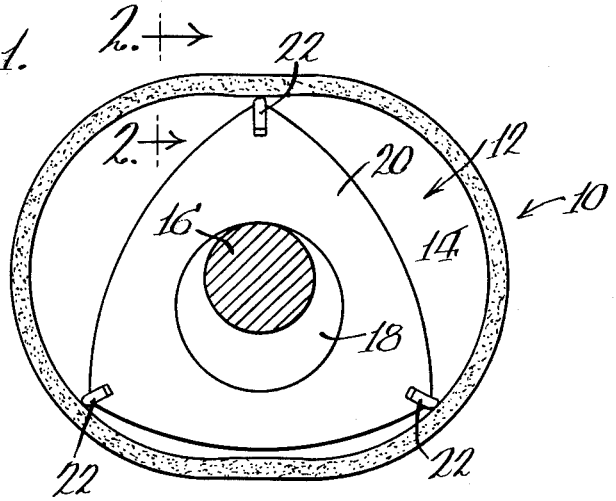
FIG. 1 is a somewhat schematic view of a rotary mechanism for which the invention is ideally suited.

One type of apparatus in which a means for precluding relative movement between housing parts made according to the invention is ideally suited is illustrated in the drawings in the form of a trochoidal, rotary mechanism having a center housing, generally designated 10, flanked by two end housings, each generally designated 12. The housings 10 and 12 define a chamber 14 and a shaft 16 is journalled in any suitable fashion in the end housings 12 and extends through the chamber 14. Within the chamber 14, the shaft 16 includes an eccentric 18 which, in turn, journals a generally triangular rotor 20 having the usual apex seals 22 at each apex thereof.

Figure 2:
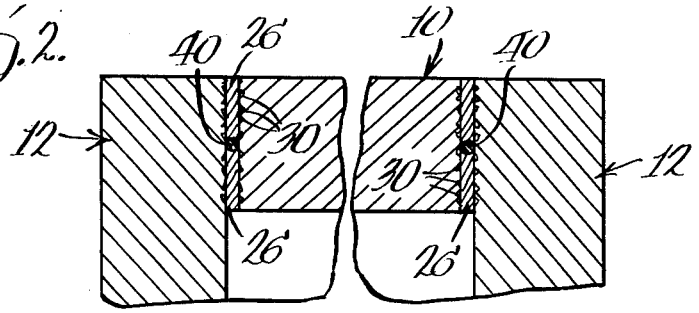
FIG. 2 is an enlarged, fragmentary sectional view taken approximately along the line 2—2.
Figure 3:
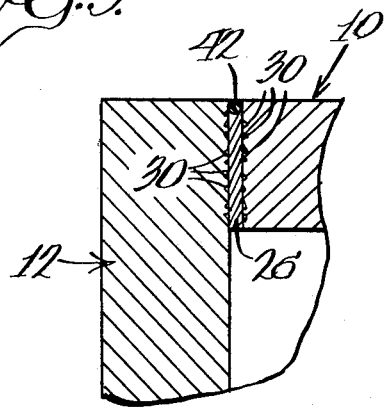
FIG. 3 is a fragmentary view similar to FIG. 2, but of a modified embodiment of the invention.
Figure 4:
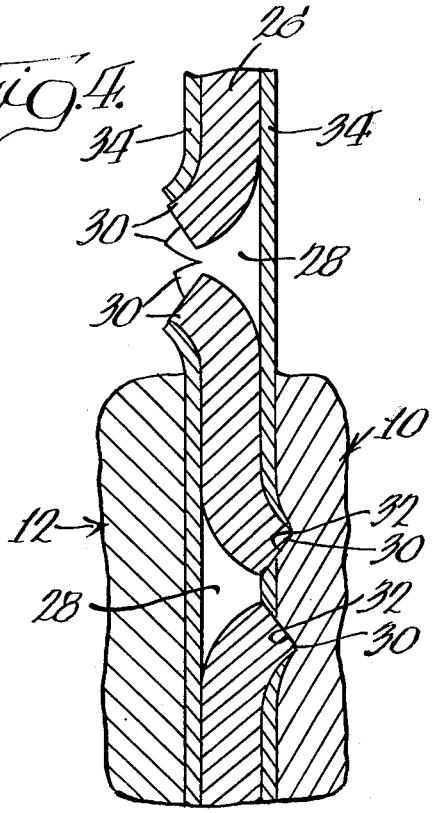
FIG. 4 is an enlarged, fragmentary view of the interface of two housing parts at which there is disposed a movement precluding means made according to the invention.

As seen in FIGS. 2–4, movement precluding means are disposed at the interfaces of the various housing parts. As seen in FIG. 4, the movement precluding means comprise a thin metallic sheet 26 which is perforated as at 28 in multiple locations so that a plurality of short prongs 30 extend from the sheet 26. The prongs 30 imbed themselves as at 32 in the housing parts as illustrated in FIG. 4 and thus firmly lock the housing parts against movement relative to the sheet 26. In the embodiment illustrated in FIG. 4, the prongs 30 extend from both sides of the sheet 26 but it is to be understood that if the sheet 26 is permanently affixed to one of the housing parts, the prongs 30 need only extend oppositely from the housing part to which the sheet is affixed to achieve the objects of the invention.

Preferably, through suitable metallurgical treating procedures known in the art, the prongs 30 are hardened to ensure good penetration into the housing parts.

Preferably, to ensure a good seal, one or both sides of the sheet 26 is provided with a layer 34 of gasket material, which gasket material preferably is applied, in liquid form if desired, such that overall thickness of the gasket assembly is not materially increased to allow the maintenance of close tolerances when the housing parts are clamped together. As can be seen in FIG. 4, the prongs 30 extend through the layer 34.

If desired, the sealing provided by the gasket material can be supplemented through the use of additional seals. In FIG. 2, O-rings 40 sealingly engage the housing parts at each interface and the sheets 26 are disposed both radially inwardly and radially outwardly of such O-rings 40. Preferably, the O-rings 40 are secured to the sheets 26 in any suitable fashion.

FIG. 3 illustrates an embodiment of the invention employing an O-ring 42, which O-ring is located at the radially outermost extremity of the sheet 26 and, again, sealingly engages the housing parts at the interface. Like the O-ring 40, the O-ring 42 preferably is secured to the sheet 26.

From the foregoing, it will be appreciated that a movement precluding means made according to the invention is inexpensive to fabricate and is positive in its performance. The many prongs which slightly imbed in the housing parts preclude relative movement of the parts with respect to each other and the use of sealing means seals the interface as well. While the invention has been described in connection with a rotary mechanism, such as a trochoidal mechanism, it is to be understood that the same will find applicability in rotary mechanisms of other types, as well as in other machinery wherein relative motion between mating parts must be prevented as, for example, in connection with oil pans, timing gear covers, gear housing covers, etc. By preventing relative movement, fretting of adjacent parts is precluded, thereby eliminating leakage in such mechanisms.

I claim:

1. A rotary mechanism comprising at least two housing parts joined to define an operating chamber, said parts being at a substantial abutment of relatively slidable surfaces, one on each part; a shaft journalled by at least one of said parts and extending into said chamber; an eccentric on said shaft and within said chamber; a rotor within said chamber and journalled on said shaft; and means for preventing relative sliding movement between said surfaces to prevent fretting thereof and to seal said chamber, said preventing means including a thin metallic sheet disposed between said parts and engaging said surfaces, said sheet being perforated to provide a plurality of prongs extending from at least one side of said sheet to be embedded in the surface adjacent said sheet one side; means on the other side of said sheet affixing said sheet to the other of said surfaces and sealing said sheet thereto, and means carried by said sheet one side sealingly engaging said adjacent surface.

2. A rotary mechanism comprising at least two housing parts joined to define an operating chamber, said parts being at a substantial abutment of relatively slidable surfaces, one on each part; a shaft journalled by at least one of said parts and extending into said chamber; an eccentric on said shaft and within said chamber; a rotor within said chamber and journalled on said shaft; and means for preventing relative sliding movement between said surfaces to prevent fretting thereof and to seal said chamber, said preventing means including a thin metallic sheet disposed between said ports and engaging said surfaces, said sheet being perforated to provide a plurality of prongs extending from both sides of said sheet to be embedded in respective ones of said surfaces to lock the same against said relative sliding movement, and two layers of gasket material, one on each side of said sheet for sealing said sheet to said surfaces, said prongs extending through said layers into said housing parts at said surfaces.

3. The rotary mechanism of claim 2 further including an O-ring carried by said sheet and sealingly engaging said surfaces to supplement the sealing provided by said layers of gasket material.

* * * * *